US005674116A

United States Patent [19]

Merrill et al.

[11] Patent Number: 5,674,116

[45] Date of Patent: Oct. 7, 1997

[54] DISC WITH COOLANT PASSAGES FOR AN ABRASIVE MACHINING ASSEMBLY

[75] Inventors: Daniel L. Merrill, Grand Haven; John R. Synder, New Era; Chuck O. Eckholm, Jr., Montague; Steve M. Sunday, Rothbury; John L. Seaver, Montague, all of Mich.

[73] Assignee: CMI International Inc., Southfield, Mich.

[21] Appl. No.: 731,032

[22] Filed: Oct. 9, 1996

[51] Int. Cl.[6] ..... B24B 5/00

[52] U.S. Cl. ..... 451/292; 540/550; 540/269; 540/268

[58] Field of Search ..... 451/259, 268, 451/269, 283, 292, 449, 450, 446, 60, 548, 540, 550, 288, 285

[56] References Cited

U.S. PATENT DOCUMENTS

| | | | |
|---|---|---|---|
| 2,719,390 | 10/1955 | Jones | 451/550 |
| 2,749,681 | 6/1956 | Reidenbach | 451/550 |
| 2,815,435 | 12/1957 | Adcock . | |
| 2,819,568 | 1/1958 | Kasick | 451/449 |
| 2,820,334 | 1/1958 | Touvay | 451/446 |
| 2,869,294 | 1/1959 | Boettcher et al. | 451/286 |
| 3,035,377 | 5/1962 | Bovensiepen et al. | 451/259 |
| 3,041,799 | 7/1962 | Kemman . | |
| 3,345,281 | 10/1967 | Falls . | |
| 3,562,964 | 2/1971 | Day | 451/449 |
| 3,754,359 | 8/1973 | Scandaletos | 451/449 |
| 3,931,696 | 1/1976 | Lorenz et al. | 451/288 |
| 3,984,945 | 10/1976 | Messerschmidt | 451/268 |
| 4,481,742 | 11/1984 | Shimizu et al. | 451/292 |
| 4,502,252 | 3/1985 | Iwabuchi | 451/269 |
| 4,523,411 | 6/1985 | Freerks . | |
| 4,663,890 | 5/1987 | Brandt | 451/292 |
| 5,076,024 | 12/1991 | Akagawa et al. | 451/550 |
| 5,140,774 | 8/1992 | Onodera | 451/269 |
| 5,584,750 | 12/1996 | Ishida et al. | 451/446 |

FOREIGN PATENT DOCUMENTS

| | | | |
|---|---|---|---|
| 26287 | 11/1906 | United Kingdom | 451/550 |

*Primary Examiner*—James G. Smith
*Assistant Examiner*—Derris Banks
*Attorney, Agent, or Firm*—Howard & Howard

[57] ABSTRACT

An abrasive machining assembly (10) wherein a worktable (14) is rotatably supported on a frame (12) for rotation about a table axis (A) and a plurality of platens (32) are supported on the worktable (14) with each of the platens (32) being adapted for supporting a workpiece to be machined by a machining disc (38) rotating about a tool axis (B). Each platen (32) is rotatably supported for rotation about a platen axis (C) which is radially spaced from the table axis (A) a different distance than the tool axis (B) whereby each of the platens (32) rotates about a platen axis (C) which is parallel to and offset from the tool axis (B) when positioned in the workstation. The assembly is characterized by a drive mechanism for selective driving engagement with the workstation platen (32) to rotate the workstation platen (32) and for disengaging the workstation platen (32) during the indexing of the worktable (14) to move the workstation platen (32) out of the workstation while moving another platen (32) into the workstation. This drive mechanism comprises a vertically movable shaft (56) which is rotated by a pulley (70) and selectively moved up and down by a pneumatic actuator (64) to engage and disengage the workstation platen (32).

16 Claims, 5 Drawing Sheets

32
36
C
34
36
24
18
A
32
36
34
32
36
14
60
56
62
20
22
16
60
70
66
66
68
58
64
30
26
28
12

DISC WITH COOLANT PASSAGES FOR AN ABRASIVE MACHINING ASSEMBLY

TECHNICAL FIELD

The present invention relates to the machining of workpieces which are rotatably supported on an indexing worktable for movement into a workstation under a machining disc.

BACKGROUND OF THE INVENTION

Various assemblies are known which machine a workpiece by rotating a flat machining disc against a workpiece. Typically a coolant fluid is communicated via passages to the face of the machining disc. A recent development has produce a machine as discribed herein which is capable of heretofore untainable rotary speeds of the machining disc. However, the known machining discs have passages which impede the flow of coolant fluid to the face of the machining disc. In other words, the high centrifugal forces tend to trap the fluid.

Examples of such prior an discs are shown in U.S. Pat. Nos. 2,815,435 to Adcock, 3,041,799 to Kemman, 3,345,281 to Falls and 4,523,411 to Freerks.

SUMMARY OF THE INVENTION AND ADVANTAGES

A machining disc for machining a workpiece and defined by a disc body having a central coolant chamber and radial passages extending radially for conveying fluid radially from the central coolant chamber and axial passages for conveying fluid axially from the radial passages to said machining face. The assembly is characterized by each of the radial passages increasing in axial dimension from a radially inward small end to a radially outwardly disposed large end.

The subject invention, therefore, provides a unique passage configuration which utilizes centrifugal forces to enhance the flow of coolant fluid to the face of the machining disc.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
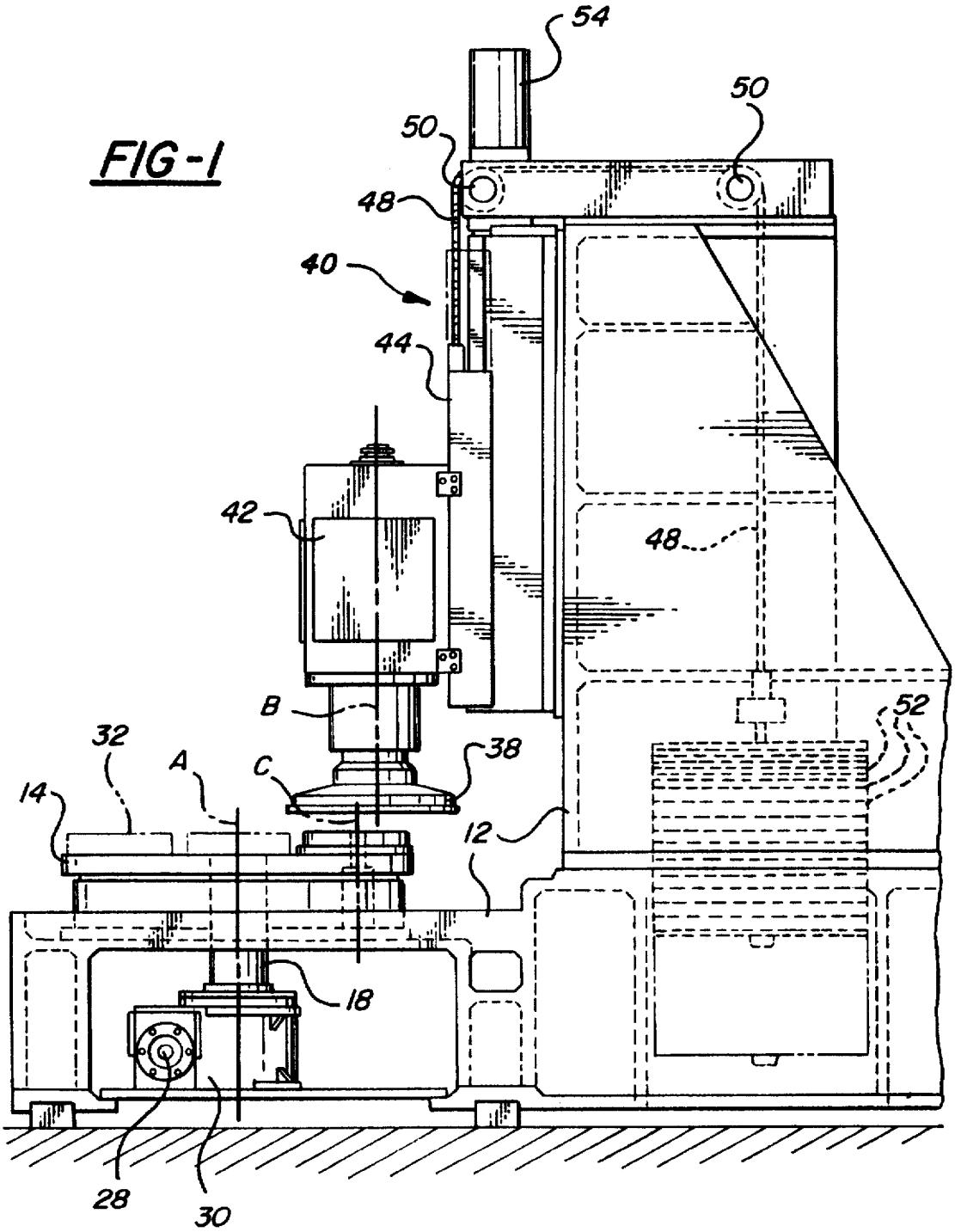
FIG. 1 is a side elevational view of an assembly for using the machining disc of the subject invention.
Figure 2:
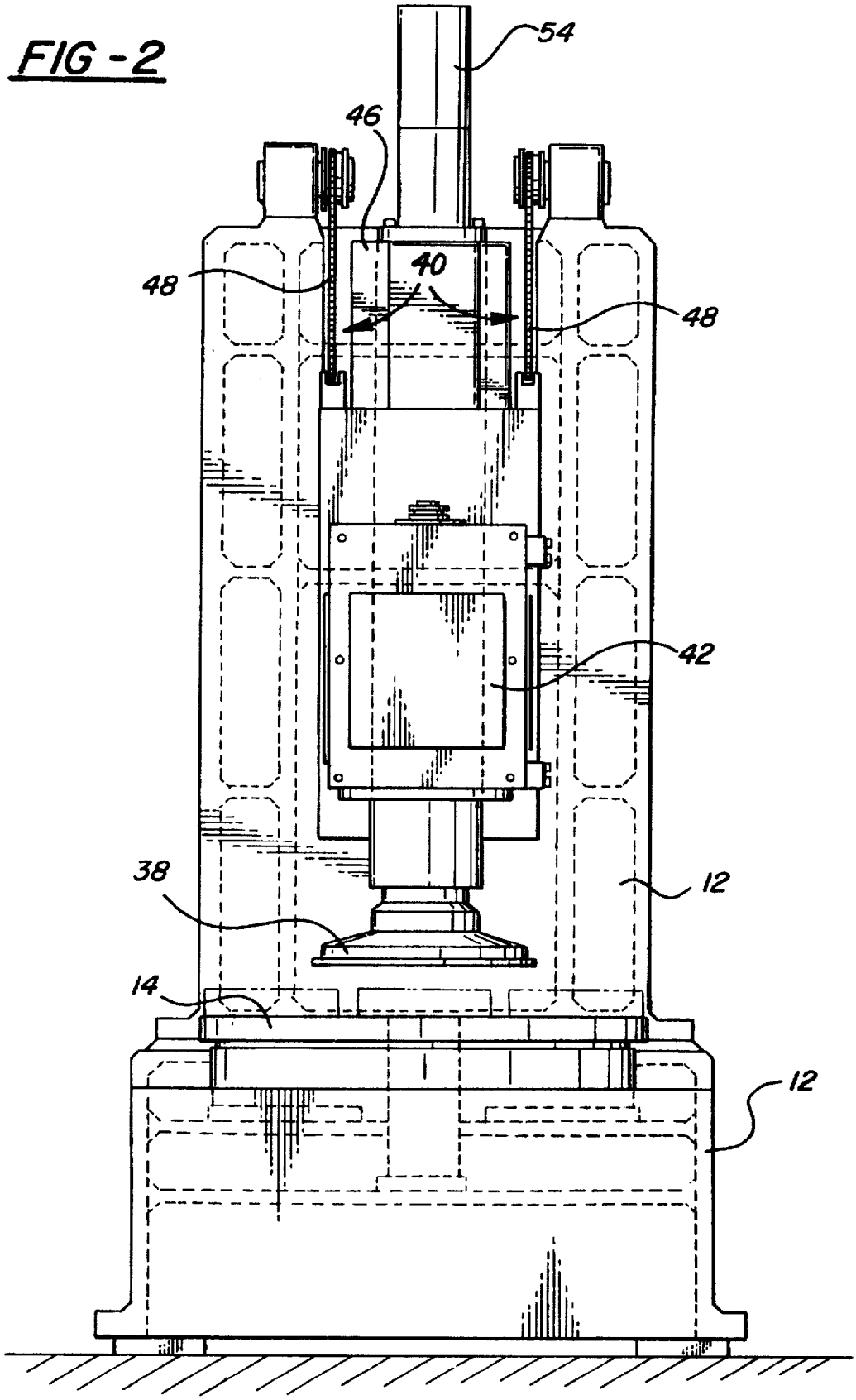
FIG. 2 is is a front elevational view of the assembly of FIG. 1.
Figure 3:
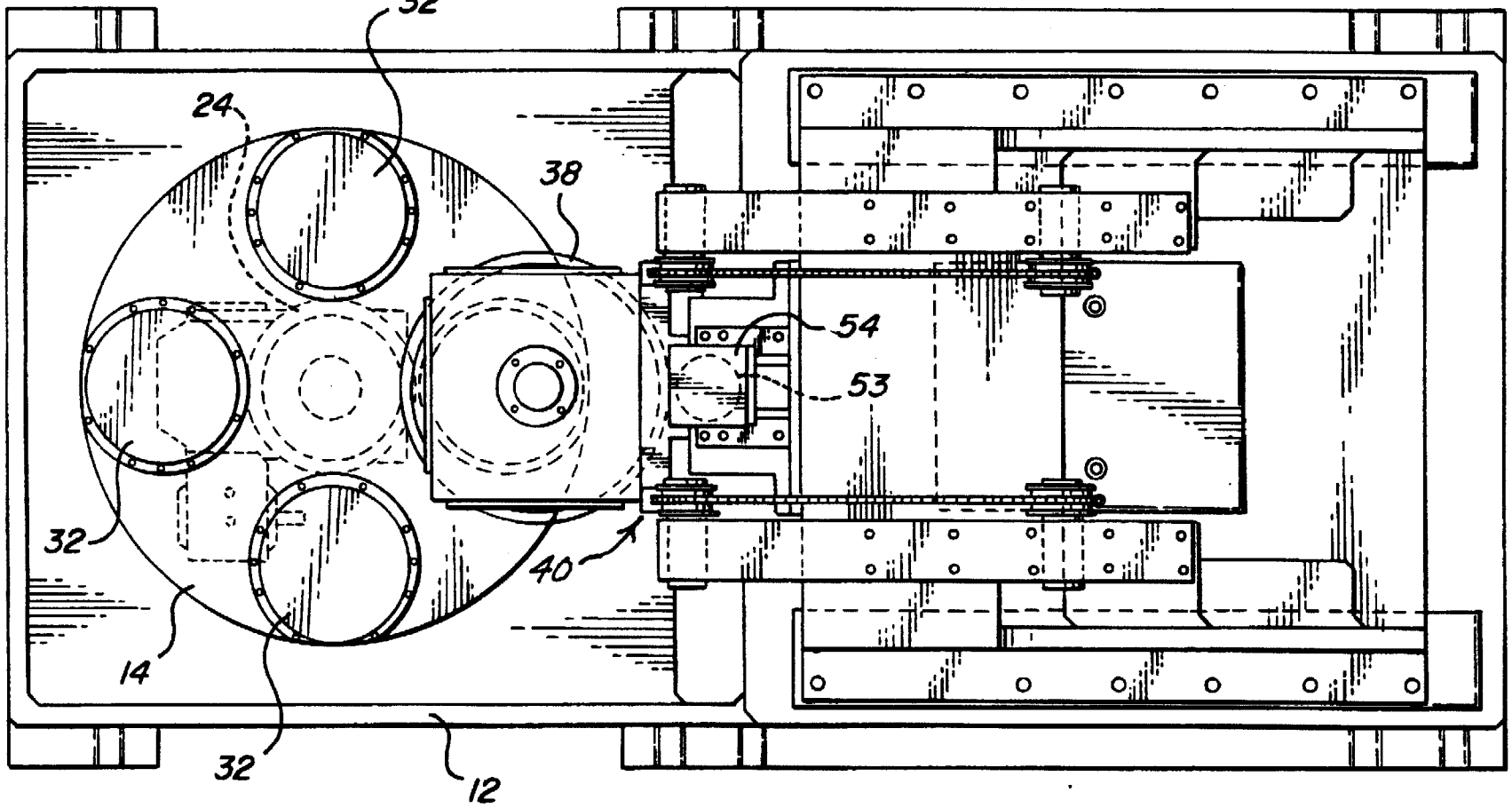
FIG. 3 is a top view of the assembly of FIG. 1.
Figure 4:
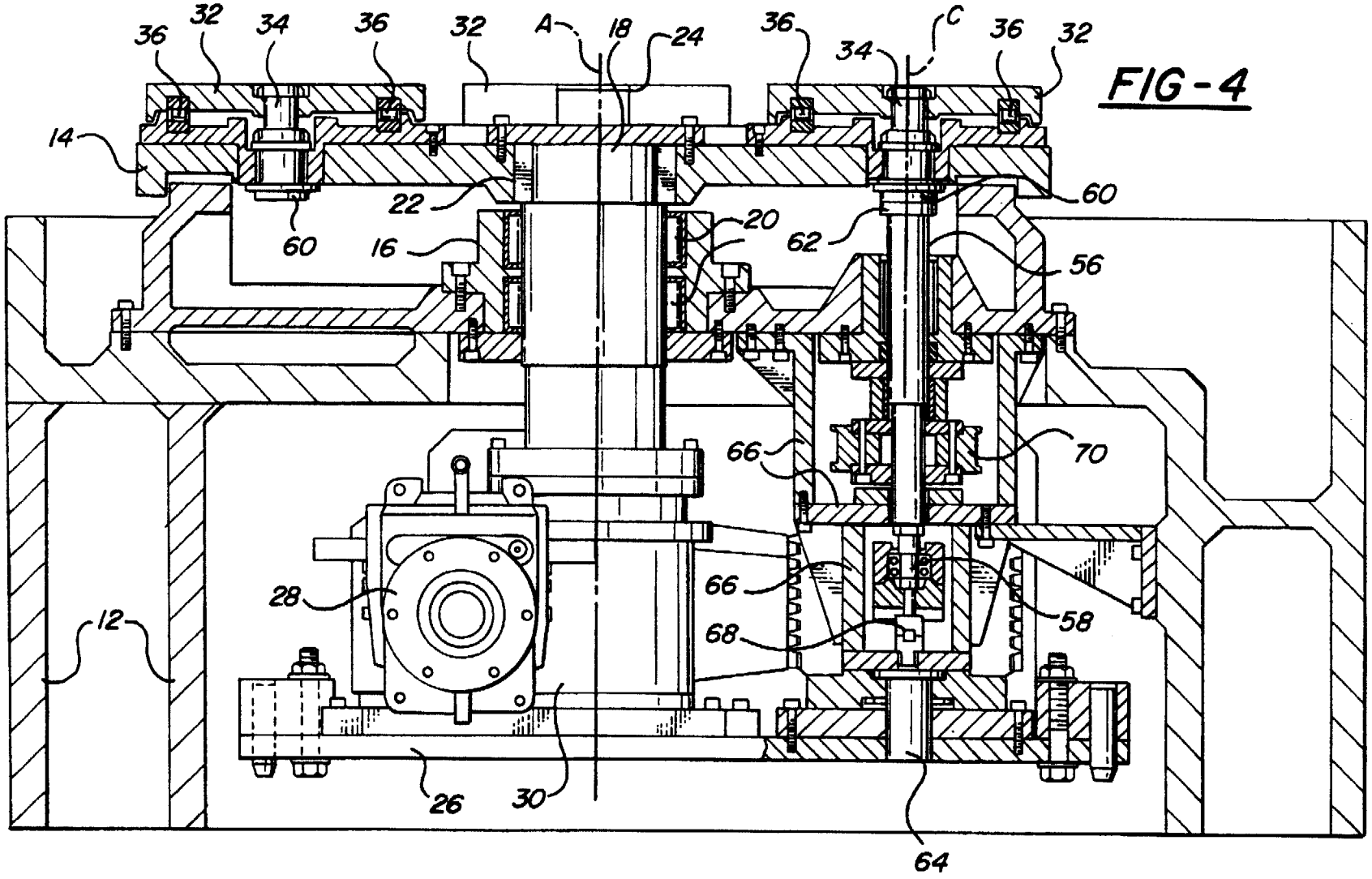
FIG. 4 is an enlarged side view of the bottom portion of the assembly of FIG. 1.
Figure 5:
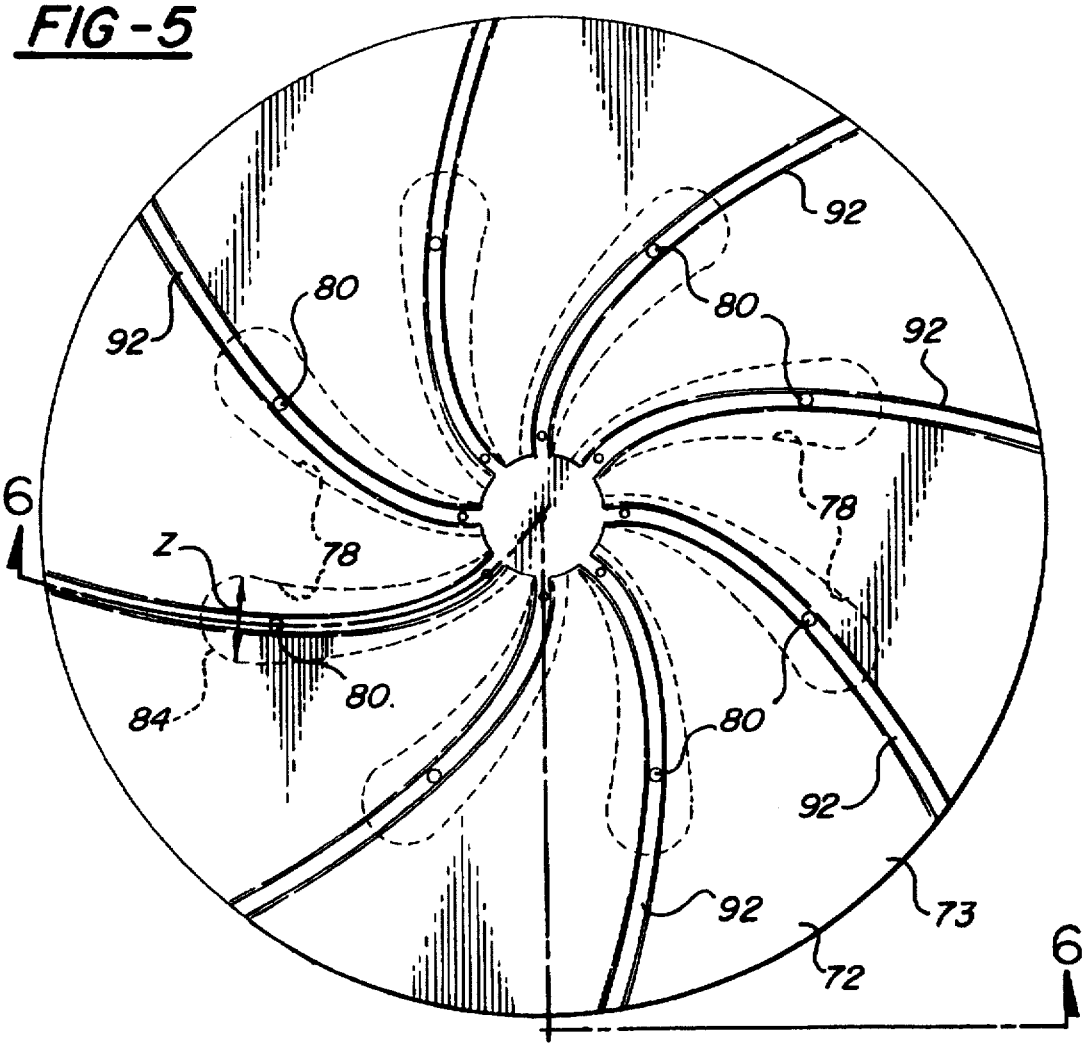
FIG. 5 is plan view of the face of the machining disc of the subject invention.
Figure 6:
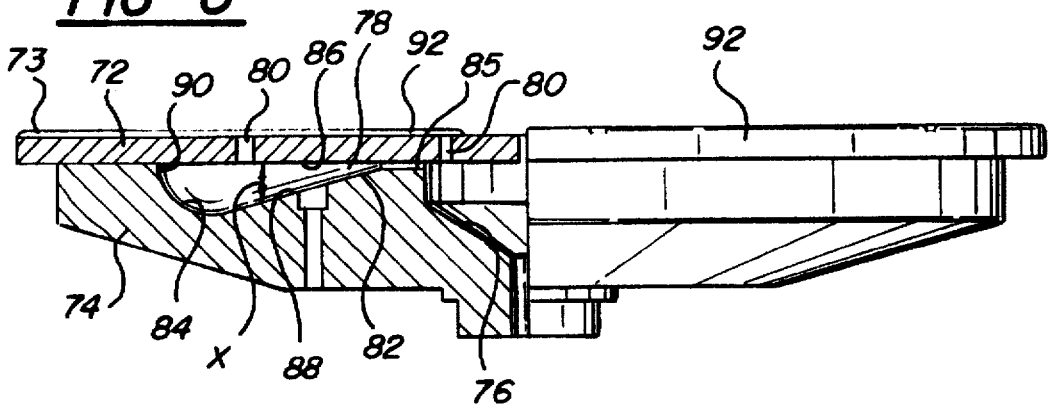
FIG. 6 is a cross sectional view taken along line 6—6 of FIG. 5.

Referring to the Figures, wherein like numerals indicate like or corresponding parts throughout the several views, an abrasive machining assembly is generally shown at 10.

The assembly 10 includes a frame 12 comprising a plurality of castings bolted together to provide a support structure. A worktable 14 is rotatably supported on the frame 12 for rotation about a table axis A. More specifically, a bearing hub 16 is bolted to the frame 12 and rotatably supports a table drive shaft 18 through the bearings 20. A drive key 22 interconnects the table shaft 18 and the worktable 14 so that they rotate together. A lube manifold flange 24 is bolted to the worktable 14 and to the top of the table shaft 18. A mounting plate 26 is supported by the frame 12 and, in turn, supports an electric motor 28. The electric motor 28 rotates the table shaft 18 through a gearbox or equivalent transmission 30.

A plurality of platens 32 are supported on the worktable 14, each of the platens 32 being adapted for supporting a workpiece (not shown) to be machined. Each platen 32 is fixed to a spindle 34 which is rotatably supported by the worktable 14 for rotation about platen axes B. Therefore, each platen 32 is supported for rotation about a platen axis C which is radially spaced from the table axis A a different distance than the tool axis B whereby each of the platens 32 rotates about a platen axis C which is parallel to and offset from the tool axis B when positioned in the workstation.

A machining disc 38 is supported by the frame 12 for rotation about a tool axis C. The tool axis C is spaced radially of the table axis A and at a workstation. A lift mechanism 40 moves the machining disc 38 vertically into and out of engagement with a workpiece on the workstation platen 32. Accordingly, the workstation platen 32 is the platen 32 positioned under the machining disc 38. The electric motor 28 and transmission 30, therefore, define an indexing mechanism for rotating the worktable 14 to serially move each of the platens 32 into the workstation to define a workstation platen 32 and to subsequently move each of the platens 32 out of the workstation.

The lift mechanism 40 comprises an electric motor 42 for rotating the disc 38, the motor 42 being supported on a slide 44 which is, in turn, slidably supported on the guides 46. A chain 48 is entrained over rollers 50 and is connected to counterweights 52 for counterbalancing the weight of the motor 42 and disc 38 assembly. A ball/screw assembly 53 is disposed vertically between the two guides 46 and is driven by a servo-motor 54 for moving the disc 38 vertically into and out of engagement with a workpiece on the workstation platen 32. The ball/screw 53 is of the type which may be purchased form Tarn-Tek, Inc., of Traverse City, Mich. 49684.

A drive mechanism is included for selective driving engagement with the workstation platen 32 to rotate the workstation platen 32 and for disengaging the workstation platen 32 during the indexing of the worktable 14 to move the workstation platen 32 out of the workstation while moving another platen 32 into the workstation. This drive mechanism is supported under the workstation and is vertically movable into and out of engagement with the workstation platen 32. The drive mechanism includes a drive shaft 56 having a bottom end 58 and a top end, the top end being vertically movable into and out of coupled engagement with the workstation platen 32 to rotate the workstation platen 32. More specifically, a driven face spline 60 is secured to the bottom of each of the platens 32 and a drive face spline 62 is secured to the top end of the drive shaft 56 whereby the drive face spline 62 is moved vertically into driving engagement with the driven face spline 60 on the workstation platen 32. The face splines 60 and 62 are well known in the mechanism arts and merely comprise mating crossed ridges and grooves.

An actuator 64 is coupled to the bottom end of the drive shaft 56 for moving the drive face spline 62 on the top end of the drive shaft 56 vertically into and out of rotary driving engagement with the driven face spline 60 on the bottom of the workstation platen 32. The framework 66 is bolted or other wise secured to the frame 12 and supports the pneumatic actuator 64. The pneumatic actuator 64 is connected to the bottom of the shaft 56 through an alignment coupler 68. A timing belt or shaft pulley 70 is splined to the shaft 56 for rotating the shaft 56 as the shaft 56 is free to move vertically through the pulley 70. A shaft motor is coupled to the pulley 70 by a belt entrained thereabout for rotating the pulley 70.

In the preferred embodiment, the disc 38 is of a cubic boron nitride and is rotated at an rpm sufficient to produce at least 20,000 linear feet per minute. At the same time, the workstation platen 32 is rotated at an rpm significantly slower than the rpm of the tool 38, i.e., in the range of 40 to 500 rpm.

The machining disc 38 comprises a disc body fabricated from a circular plate 72 and a hub 74. The plate 72 presents a machining face 73. The body has a central coolant chamber 76 and radial passages 78 extending radially for conveying fluid radially from the central coolant chamber 76 and axial passages 80 for conveying fluid axially from the radial passages 76 to the machining face 73.

The machining disc 38 is characterized by each of the radial passages 78 increasing in axial dimension (x) from a radially inward small end 82 to a radially outwardly disposed large end 84. The smal ends are in fluid communication with the coolant chamber 76 via flattened portions 85 which have a rectangular cross section. Each of the radial passages 78 is defined by a fiat bottom wall 86 parallel to the machining face 73 and a top wall 88 inclined upwardly away from the bottom wall 86 in the radial direction. The radially outward end 84 of each radial passage 78 curves from the topwall 88 and joins the bottom wall 86 at an acute angel to define a sharp comer 90. The sharp comer 90 is arcuate as viewed in the direction perpendicular to the machining face 73. In addition, each radial passage 78 increases in circumferential dimension (z) from the small end 82 to the large end 84.

The machining face 73 includes grooves 92 therein which spiral from the center of the disc and the axial passages 80 communicate with the grooves 73. The radial passages 78 are also spiralled from the tool axis (B) and overlie the grooves 73.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An abrasive machining assembly (10) comprising:

a frame (12), a worktable (14) rotatably supported on said frame (12) for rotation about a table axis (A) and presenting a machining face (73), a plurality of platens (32) supported on said worktable (14), each of said platens (32) being adapted for supporting a workpiece to be machined, a machining disc (38) supported by said frame (12) for rotation about a tool axis (B) and presenting a machining face, said tool axis (B) being spaced radially of said table axis (A) at a workstation, an indexing mechanism for rotating said worktable (14) to serially move each of said platens (32) into said workstation to define a workstation platen (32) and to subsequently move each of said platens (32) out of said workstation, a lift mechanism for moving said machining disc (38) vertically into and out of engagement with a workpiece on said workstation platen (32), each platen (32) being rotatably supported for rotation about a platen axis (C) which is radially spaced from said table axis (A) a different distance than said tool axis (B) whereby each of said platens (32) rotates about a platen axis (C) which is parallel to and offset from said tool axis (B) when positioned in said workstation, said machining disc (38) having a central coolant chamber (76) and radial passages (78) extending radially for conveying fluid radially from said central coolant chamber (76) and axial passages (78) for conveying fluid axially from said radial passages (78) to said machining face (73), said assembly characterized by each of said radial passages (78) increasing in axial dimension from a radially inward small end (82) to a radially outwardly disposed large end (84).

2. An assembly as set forth in claim 1 wherein each of said radial passages (78) is defined by a flat bottom wall (86) parallel to said machining face (73) and a top wall (88) inclined upwardly away from said bottom wall (86) in the radial direction.

3. An assembly as set forth in claim 2 wherein said large end (84) of each radial passage (78) curves from said top wall (88) and joins said bottom wall (86) at an acute angle to define a sharp corner (90).

4. An assembly as set forth in claim 3 wherein each of said radial passages (78) increases in circumferential dimension (z) from said small end (82) to said large end (84).

5. An assembly as set forth in claim 4 wherein said machining face (73) includes grooves (92) therein and said axial passages (78) communicate with said grooves (92).

6. An assembly as set forth in claim 5 wherein said grooves (92) are spiralled from said tool axis (B).

7. An assembly as set forth in claim 6 wherein said radial passages (78) are spiralled from said tool axis (B) and overlie said grooves (92).

8. An assembly as set forth in claim 7 wherein said sharp corner (90) is arcuate as viewed in the direction perpendicular to said machining face (73).

9. An assembly as set forth in claim 8 wherein each of said radial passages (78) is larger in transverse cross sectional area than said grooves (92).

10. A machining disc for machining a workpiece and comprising:

a disc body, said body having a central coolant chamber (76) and radial passages (78) extending radially for conveying fluid radially from said central coolant chamber (76) and axial passages (80) for conveying fluid axially from said radial passages (78) to said machining face (73), said assembly characterized by each of said radial passages (78) increasing in axial dimension (x) from a radially inward small end (82) to a radially outwardly disposed large end (84).

11. An assembly as set forth in claim 10 wherein each of said radial passages (78) is defined by a flat bottom wall (86) parallel to said machining face (73) and a top wall (88) inclined upwardly away from said bottom wall (86) in the radial direction.

12. An assembly as set forth in claim 11 wherein the large end (84) of each of said radial passages (78) curves from said topwall and joins said bottom wall (86) at an acute angle to define a sharp corner (90).

13. An assembly as set forth in claim 12 wherein each of said radial passages (78) increases in circumferential dimension (z) from said small end (82) to said large end (84).

14. An assembly as set forth in claim 13 wherein said machining face (73) includes grooves (92) therein and said axial passages (80) communicate with said grooves (92).

15. An assembly as set forth in claim 14 wherein said radial passages (78) are spiralled from said tool axis (B) and overlie said grooves (92).

16. An assembly as set forth in claim 15 wherein said sharp corner (90) is arcuate as viewed in the direction perpendicular to said machining face (73).

* * * * *